US006705380B2

(12) United States Patent
Scolletta

(10) Patent No.: US 6,705,380 B2
(45) Date of Patent: Mar. 16, 2004

(54) FABRIC RETAINER

(76) Inventor: Josephine Scolletta, 2621 Stonegate Dr., Jacksonville, FL (US) 32223

( * ) Notice: Subject to any disclaimer, the term of this patent is extended or adjusted under 35 U.S.C. 154(b) by 0 days.

(21) Appl. No.: 10/011,123

(22) Filed: Dec. 7, 2001

(65) Prior Publication Data

US 2002/0069979 A1 Jun. 13, 2002

Related U.S. Application Data

(60) Provisional application No. 60/254,044, filed on Dec. 7, 2000.

(51) Int. Cl.[7] ..... A47H 19/00

(52) U.S. Cl. ..... 160/349.2; 24/703.1

(58) Field of Search ..... 160/349.2, 349.1; 446/374, 73, 370; 24/703.1

(56) References Cited

U.S. PATENT DOCUMENTS

| | | | | | |
|---|---|---|---|---|---|
| 2,316,337 | A | * | 4/1943 | Kenny | |
| 3,206,889 | A | * | 9/1965 | Ryan | |
| 3,789,547 | A | * | 2/1974 | Chemarin | |
| 4,170,086 | A | * | 10/1979 | Hills | |
| 4,233,775 | A | * | 11/1980 | Neufeld | 446/370 |
| 4,278,714 | A | * | 7/1981 | Schwartz | |
| 4,543,278 | A | * | 9/1985 | Ackerman | 428/18 |
| 4,903,846 | A | * | 2/1990 | Smith | 211/113 |
| 4,950,196 | A | * | 8/1990 | Fortune et al. | |
| 5,071,385 | A | * | 12/1991 | Cox | |
| 5,217,192 | A | * | 6/1993 | Oktayuren | |
| 5,240,059 | A | * | 8/1993 | White | |
| 5,501,627 | A | * | 3/1996 | Ekstein | |
| D394,682 | S | * | 5/1998 | Marcus | |
| 6,056,618 | A | * | 5/2000 | Larian | |
| 6,193,579 | B1 | * | 2/2001 | Mak | |
| 6,217,406 | B1 | * | 4/2001 | Ross | |
| 6,237,759 | B1 | * | 5/2001 | Wotton | |
| 6,244,326 | B1 | * | 6/2001 | Grieco | |
| 2003/0186614 | A1 | * | 10/2003 | Taylor | 446/26 |

FOREIGN PATENT DOCUMENTS

| | | | |
|---|---|---|---|
| FR | 2625087 | * | 12/1987 |
| JP | 10-177361 | * | 6/1998 |

* cited by examiner

*Primary Examiner*—Blair M. Johnson
(74) *Attorney, Agent, or Firm*—Richard S. Vermut; Rogers Towers, P.A.

(57) ABSTRACT

A fabric retainer for altering the natural repose of a hanging piece of fabric. The device comprises a decorative body having a member with movable appendages extending therefrom. A portion of at least one of the appendages is designed to be connected to the decorative body such that a passage is formed in which the fabric can be positioned. The decorative body can be designed to represent animate or inanimate objects, or characters.

12 Claims, 5 Drawing Sheets

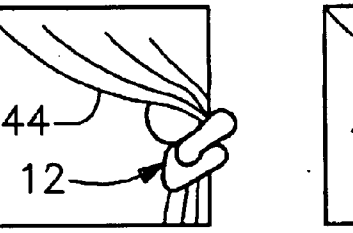
Fig. 10K
Fig. 10L
Fig. 10M
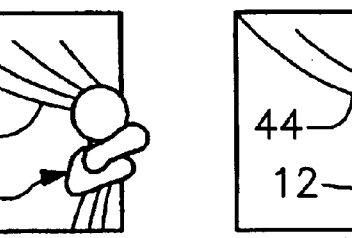
Fig. 10N
Fig. 10O
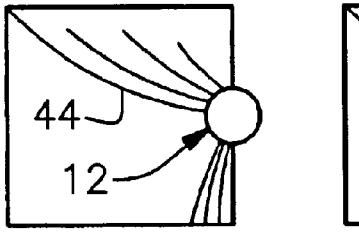
Fig. 10P
Fig. 10Q
Fig. 10R
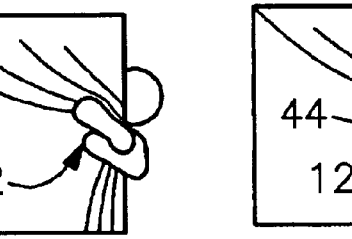
Fig. 10S
Fig. 10T

FABRIC RETAINER

CROSS REFERENCE

This patent application claims priority to provisional patent application No. 60/254,044 filed on Dec. 7, 2000 titled "Decorative Curtain Holder" by Josephine Scolletta. The disclosure of the provisional application is incorporated in its entirety herein by reference.

FIELD OF THE INVENTION

The present invention is generally directed to home furnishings and is more specifically directed to a retainer for altering the natural repose of a hanging, flexible material, such as a curtain.

BACKGROUND OF THE INVENTION

A potential decorating feature used in a home, or other living space, is the hanging of fabric. Fabric can be hung from numerous types of hangers such as rods and hooks. Typical uses for hung fabric include drapes, window treatments, or wall treatments. When hung, however, fabric is subject to the forces of gravity that determine the repose, or drape, of the fabric. In certain circumstances altering the repose can yield an entirely different look. a wall or a hook, which is rigid and has a gap, mounted on a surface such as a wall. These tieback methods provide a means for imparting to the curtain a swag.

Both of the above devices present the designer with limited alternatives for decorating a window. In the case of flexible tiebacks, different colors, patterns, and textures can be selected. Hooks on the other hand come is various geometric designs such as spirals, discs, and points. In general, these methods of altering the repose of drapes are simple and plain being more functional than decorative. Thus the tiebacks are not a design element. It would be beneficial if a tieback supported the overall design theme of a room by becoming a focal design element. It would also be beneficial if tiebacks could be changed throughout the year to recognize changes in seasons or support holiday decoration. It would also be beneficial if the arrangement of the tieback could be altered.

Based on the foregoing, it is the object of the present invention to develop a fabric retainer that will increase the design alternatives for altering the repose of hanging fabric that overcomes the problems and drawbacks associated with the prior art.

SUMMARY OF THE INVENTION

The present invention is directed in one aspect to a fabric retainer for altering the natural repose of a piece of hanging flexible material that includes a decorative body and at least a portion of a hanging means associated therewith. The decorative body includes a member flexibly coupled to at least one appendage. A retaining means for temporarily securing a portion of the at least one appendage to the decorative body is provided such that when the portion is connected to the decorative body a passage is defined. The flexible, hanging material passes through the passage. Hanging means with at least a portion of the hanging means associated with the decorative body is provided for mounting the decorative body to a surface.

The member and appendages can cooperate to suggest for the decorative body any decorative design. For example, the member could be designed to represent the torso of a bear and the appendages the limbs of the bear giving the decorative body the design of a portion of a bear. In another example, the member could be designed to represent the head of a bear. In yet another design, the member could be designed to be a portion of the head of an animal such as an alligator with the appendages being the jaws of the alligator. It should be readily realized that bears are not the only candidates for the decorative design as other animals imaginary or real are also possible. In addition, the invention should not be considered limited to animals or other animate objects, as inanimate objects such as a football helmet or characters of any kind could be used. In the case of a football helmet, the helmet portion of the football helmet could be the member and the face guard could be divided into two segments, each segment being an appendage.

The decorative body and the appendages can be made from almost any material and it is not required that they be made of the same material. Materials such as plastic, metal and fabric are possible. In a preferred embodiment, the body, or various parts thereof, are made from fabric and stuffed such that the decorative body represents a portion of or a whole stuffed figure. Stuffing adds depth and contour to the design.

The means for securing a portion of an appendage to the decorative body can be of almost any design such as hook and loop, snap, magnets, ties, or even pins. In one embodiment where it is desirable to connect the ends of the appendages to define the passage, the ends of the appendages have a complementary fastener. The invention, however, should not be considered so limited as the member could have a complementary part of a fastener to fastener part on the appendages, or a single appendage could have a complementary fastener.

The hanging means is designed to mount the decorative body to a surface, such as a wall, ceiling or even a bracket such as a curtain rod. The design of the hanging means is application dependent. A desirable additional feature of the hanging means is that it provide temporarily attachment of the decorative body to the wall, so that if desired the decorative body can be changed either in response to a change is seasons, a holiday or a change in room décor without disturbing the wall or require re-hanging of the hanging means. Temporary attachment can be accomplished by temporary attachment of the hanging means to the decorative body, a two piece hanging means design with one part remaining attached to the decorative body and the other to the surface such as a ring on the decorative body and a hook on the wall, temporary attachment of the hanging means to the wall such as by tack, tape or suction cups, or a cavity on the decorative body into which the hanging means slips. Other temporary attachment methods are also possible. Only a portion of the hanging means need be associated with the decorative body as the user could provide the other portions. For example, the decorative body could have a loop, ring, or cavity designed to accept a bracket, or hook or even a tab through which a push pin, nail, or tack could be pushed with the required bracket, hook, push pin, nail or tack being otherwise provided.

In another embodiment of the invention, the decorative body includes another member that is coupled to the member to enhance the decorative body. Continuing with the bear analogy, the other member could be fashioned to resemble the head of the bear. The head may have means for fixing it in position relative the other member or the appendages.

In yet another embodiment of the invention, additional appendages could extend from the decorative body. A third and even fourth or more appendages could be added. Again continuing with the bear analogy, the additional appendages could be the other limbs of the bear.

As mentioned above, the temporary securing of a portion of the appendages to the body or other appendages should be such that multiple configurations of the appendages are possible. In the case of a two part fastener wherein the fastener as a first part and a second part, this may mean having more of one part than the other. For example continuing with a decorative body resembling a bear, the first part of the fastener could be located on the paws of the bear at the end of the limb. Second parts could be located intermediate on the limb between the paw and the point of connection of the limb to the torso, on other limbs, or on any of the members, such as the torso or head. By having multiple second parts, the limb can be attached to itself, other limbs or other parts of the decorative body resulting in numerous different configurations of the bear as it retains the hanging material.

Additionally, the decorative body could include an adjustable skeleton, such as wires. The skeleton can be completely throughout the body or within a portion of the body such as a member or appendage. The skeleton can be an exoskeleton or an endoskeleton depending on the decorative requirements of the decorative body. The skeleton gives the user more options for configuring the decorative body. Preferably, the skeleton would be bendable in the sense that the shape could be change from one position to another. In one embodiment, the member has a main structure within the member with extensions therefrom into the appendages and other members.

Yet another feature that could be added to the decorative body is an ancillary device, mechanical or electronic. The choice of ancillary device is application dependent. Potential electronic devices range from security devices, such as intruder detectors and smoke detectors, to entertainment devices, such as a music box, radio or tape player. It is also possible to put a sensor such as a motion sensor to activate the electronic device.

The body can also be designed to hold a cord, or other similar item, extending from a curtain rod. In one embodiment, the decorative body defines a pocket into which the cord can be placed. The pocket can be of almost any design such as a separate layer of fabric sewn or a cavity within the body. It is a matter of design choice as to which part of the decorative body, member or appendage, the pocket is located.

DETAILED DESCRIPTION OF THE PREFERRED EMBODIMENTS OF THE INVENTION

Figure 1:
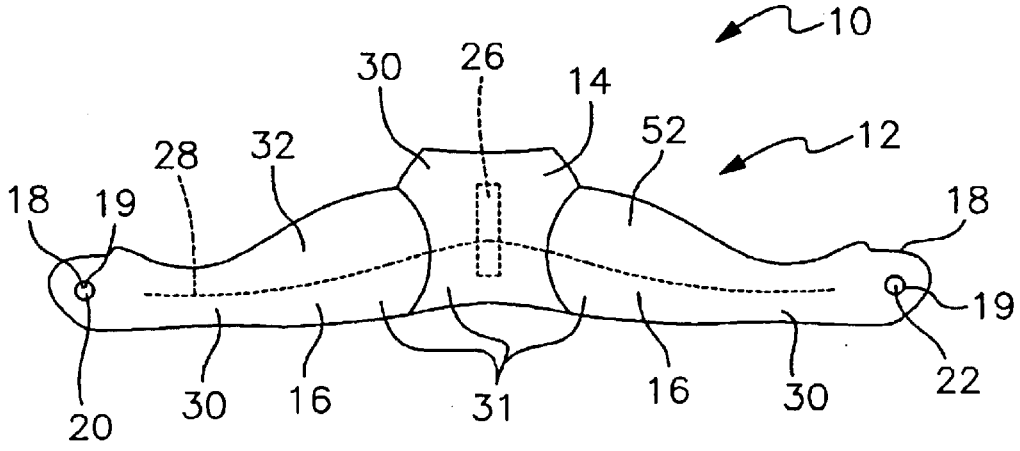
FIG. 1 is a frontal view of the present invention.
Figure 2:
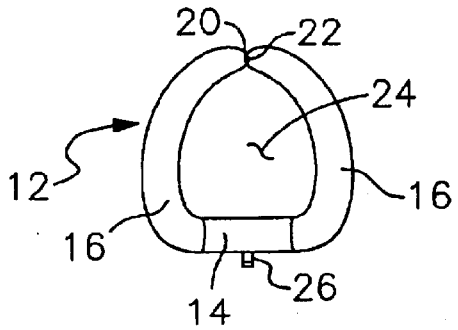
FIG. 2 is a top view of the invention depicted in FIG. 1 with the appendages defining a passage.

As shown in FIG. 1, the fabric retainer, generally referred to by reference number 10, is comprised of a decorative body generally referred to by reference number 12 having a member 14 with at least one appendage 16 flexibly connected thereto. The at least one appendage 16 has an end 18. A two part retaining means 19 comprised of a first part 20 and a second part 22 are provided to temporarily fasten a portion of at least one appendage 16 to the decorative body 12. As shown in FIG. 2, when the two appendages 16 are brought together and the first and second part 20 and 22 of the fastener engaged a passage 24 is formed through which a fabric (see FIG. 9) is positioned. Continuing with FIG. 1, connected to the decorative body 12, in this case more specifically member 14, is a bracket 26. The bracket 26 is designed to permit the body 12 to be mounted on a surface (not shown).

As shown in FIG. 1, the fabric retainer 10 can have incorporated therein a skeleton 28 designed to provide rigidity to the member 14 and the appendages 16. The skeleton 28 could also permit the contouring of the appendages 16.

The appendages 16 and the member 14 are comprised of an exterior material 30 defining a chamber 31 having a stuffing 32 positioned therein creating thereby a stuffed decorative body 12. The exterior material 30 and the stuffing 32 can form a shape such as a portion of a teddy bear or other stuffed item. It is not a requirement of the invention that the member and the appendages, or the appendages be made in the same materials. As an example, the member could be made from a rigid plastic and the appendages could be stuffed.

Figure 3:
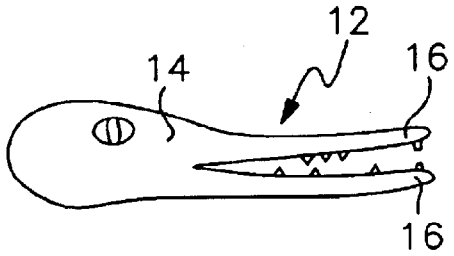
FIG. 3 is a side view of the invention where the decorative body is in the shape of an alligator.

FIG. 3 depicts a decorative body 12 in the form of an alligator. A portion of the alligator head is the member 14 and the jaws of the alligator are the appendages 16.

Figure 4:
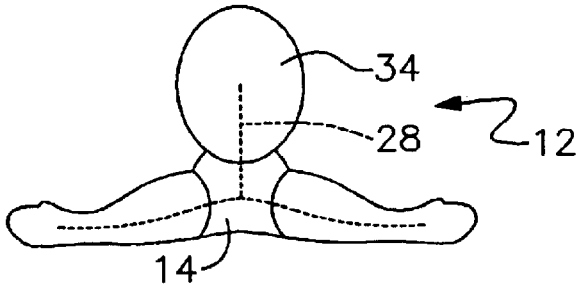
FIG. 4 is a frontal view of an enhancement of the invention depicted in FIG. 1.

FIG. 4 is the present invention wherein the decorative body 12 further comprises an additional member 34 connected to the member 14. In this depiction, the addition member 34 has been integrated into the skeleton 28. This, however, is not required.

Figure 5:
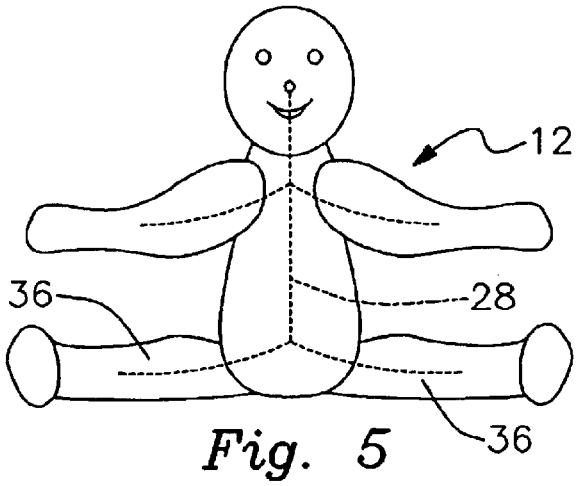
FIG. 5 is a frontal view of an enhancement of the invention depicted in FIG. 4.

Continuing with FIG. 5 in a further enhancement of the present invention, the decorative body 12 further comprises another pair of appendages 36. These appendages 36 can be integrated into the skeleton 28. It should be noted that only one appendage 36 could have been added. If desired, the other appendages 36 can be similar in construction, i.e. stuffed, to the previously discussed appendages 30.

Figure 6:
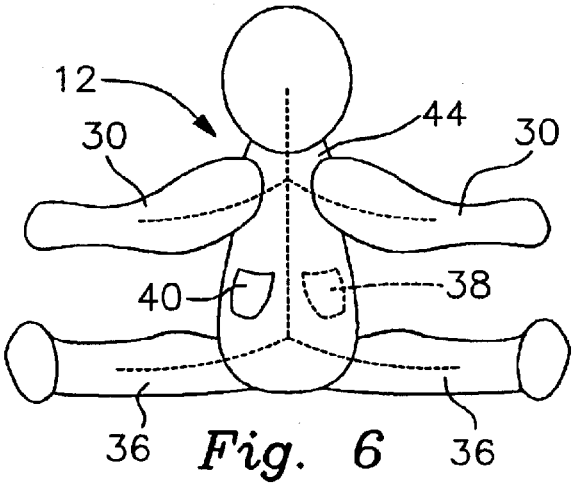
FIG. 6 is a back view of the invention depicted in FIG. 5.
Figure 7:
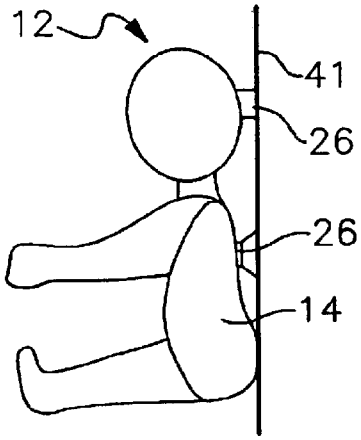
FIG. 7 is a side view of the invention depicted in FIG. 6 with the appendages extended in front and perpendicular to the member illustrating a hanging means design.

As shown in FIG. 6, an ancillary device 38, such as a security device or entertainment device, may be embedded within the decorative body 12, specifically the member 14. The ancillary device 38 could also have been attached to the outside of the decorative body 12 to any member 14 and 34 or appendage 30 and 36, or positioned within an appendage 30 and 36. As shown in FIG. 7, an actuating sensor 39, such as a motion sensor, may be connected to the ancillary device 38. Continuing with FIG. 6, a pocket is defined by the member 40 in this case by a sewn on piece of material.

Figure 8:
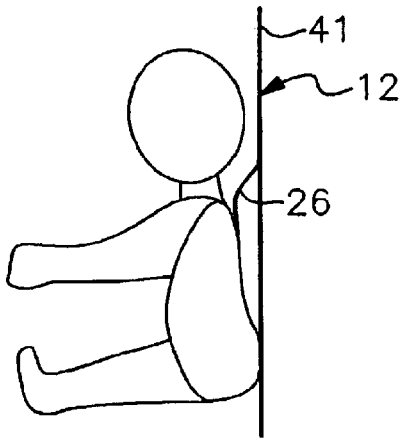
FIG. 8 is a side view of the in depicted in FIG. 6 with the appendages extended in front and perpendicular to the member illustrating an alternative hanging means.
Figure 9B:
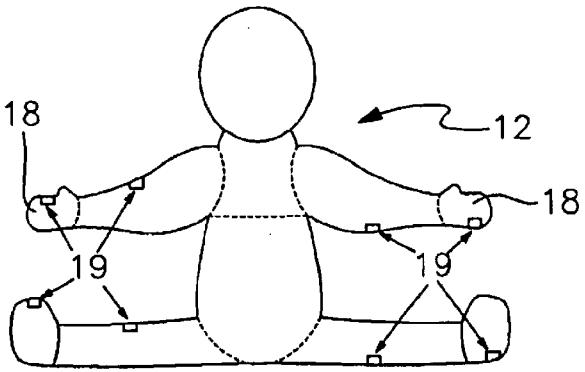
FIG. 9 is a multiple view drawing of the invention showing multiple securing arrangements for the appendages.
Figure 9A:
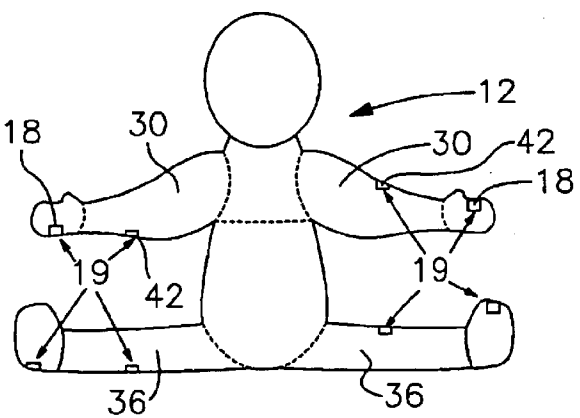
Figure 9D:
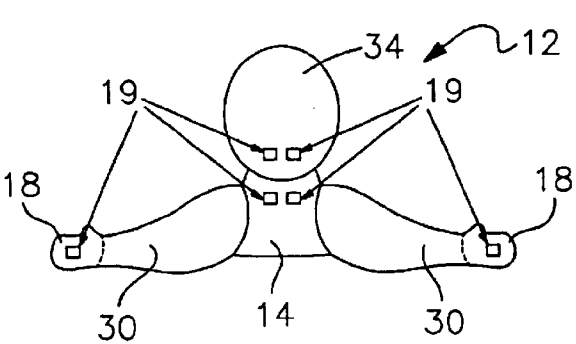
Figure 9C:
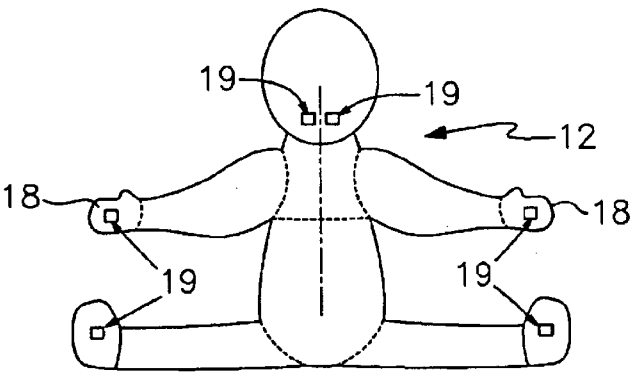
Figure 10A:
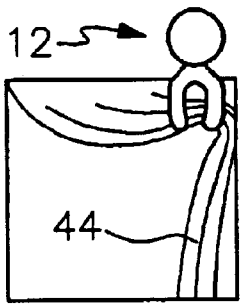
FIG. 10 is a multiple view drawing depicting the use of the various depicted embodiments with a piece of hanging fabric.
Figure 10B:
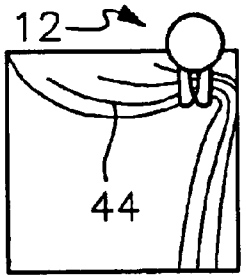
Figure 10C:
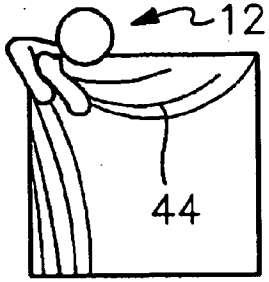
Figure 10D:
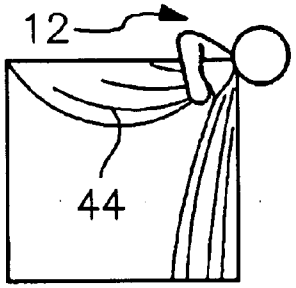
Figure 10E:
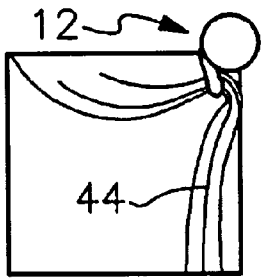
Figure 10F:
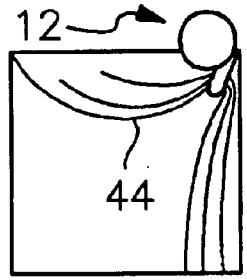
Figure 10G:
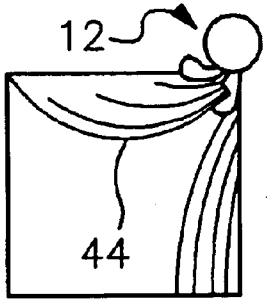
Figure 10H:
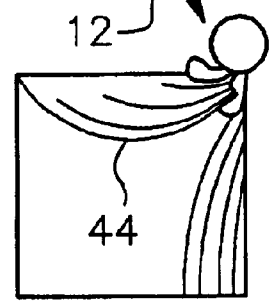
Figure 10I:
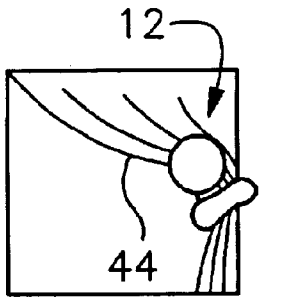
Figure 10J:
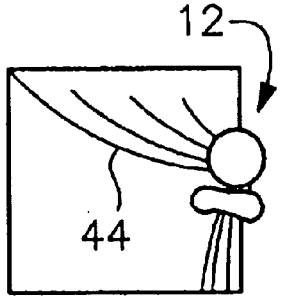

Continuing with FIG. 7, a hanging means 26 in the form of a bracket is attached to the decorative body 12 such that the decorative body may be attached to a surface 41 such as a wall. While the hanging means 26 has been depict as a bracket, other hanging means such as loops, rings, tabs, and cavities, which are defined by the decorative body, are also considered within the scope of the invention. The hanging means 26 depicted in FIG. 7 is of a multiple part design, but a single part hanging means 26 as shown in FIG. 8 could be used. The hanging means 26, which is preferably attached to the member 14, is attached to the hanging body 12 on a surface 41 that will be opposed to the surface 41. In a preferred embodiment, a multiple part hanging means 26 includes one part fixedly attached to the member 14 of the decorative body 12 and the other part to a mounting surface such as a ring on the decorative body 12 and a hook on a wall surface on which decorative body 12 is to be mounted. The hanging means 26 can take on many shapes and have any means of attachment to a surface such as nails, screws, tape, or suction cups. In addition, the hanging means 26 may be of a conforming design such as a spring bracket that would attach to a curtain rod.

FIG. 9 shows the flexibility of the present invention based on the use of multiple retaining means 19 for securing various portions of the appendages 30 and 36 to the decorative body 12. FIG. 9A shows multiple points on the appendages 30 and 36 for retaining means 19. These multiple points permit among other alternative the appendages 30 and the other appendages 36 to be connected, one appendage 30 to be connected to the other appendage 30 at the ends 18, or the appendages 30 to be secured in a crossed configuration by using the retaining means 19 at intermediate positions 42. FIG. 9B depicts the flexibility in positioning the retaining means 19 on the decorative body 12. FIG. 9C depicts further flexibility of the invention depicting retaining means 19 located on the addition member 34. Finally, FIG. 9D depicts the use of multiple retaining means with retaining means on the member 14 and the additional member 34. As FIG. 9 demonstrates, the location of the retaining means is design dependent and FIG. 9 will being extensive is not considered representative of all the possible locations and options. It should be noted that all retaining means 19 do not have to be the same or necessarily cooperate to define a passage.

FIG. 10 shows the flexibility of use of the present invention with a hanging material 44. For example, FIG. 10A shows the configuration of the invention depicted in FIG. 5 positioned at the top of a window treatment of material 44. FIG. 10B is similar to FIG. 10A except that the additional member 34 has been repositioned. It should be noted that it is not a requirement that all appendages of the decorative body 12 be used in an application. FIGS. 10B through 10R depicts the use of the invention as depicted in FIG. 3. FIGS. 10S and 10T depict the use of the invention as depicted in FIG. 1. While many examples for using the invention have been depicted, it should be apparent that the examples are not exhaustive.

The foregoing description and drawings of various embodiments of the present invention have been presented for purposes of illustration and description only. Above-identified embodiments are not intended to be exhaust or to limit the invention to the precise forms disclosed. Obvious modifications or variations are possible in light of the above teachings such as the use of other animate figures, real or imaginary, than a bear, other inanimate forms such as a football helmet and characters of any kind. The embodiments chosen provide illustration of the principles of the invention and illustrate practical applications to enable one of ordinary skill in the art to utilize the invention in various embodiments and with various modification as are suited to the particular use contemplated. All such modifications and variations are within the scope of the present invention.

What is claimed is:

1. A hanging, flexible material retainer for altering the natural repose of a piece of hanging, flexible material comprising:

a decorative body having a member flexibly connected to at least one appendage extending therefrom, retaining means for temporarily securing a portion of at least one appendage to the decorative body whereby a passage is defined wherein a hanging, flexible material is releasably retained; and hanging means comprising a first part positioned on a surface of the decorative body and a second part positioned on a mounting surface, wherein the first part engages the second part to mount the decorative body thereto.

2. The hanging, flexible material retainer of claim 1 further comprising an ancillary device retained by the decorative body.

3. The hanging, flexible material retainer of claim 2 wherein the ancillary device has an actuating sensor that activates the ancillary device.

4. The hanging, flexible material retainer of claim 1 wherein the decorative body includes less than four appendages.

5. The hanging, flexible material retainer of claim 1 wherein the decorative body includes less than three appendages.

6. The hanging, flexible material retainer of claim 1 wherein the appendages have a skeleton associated therewith for contouring the appendages.

7. A hanging, flexible material retainer for altering the natural repose of a piece of hanging, flexible material comprising:

a decorative body having a member flexibly connected to at least one appendage extending therefrom wherein a skeleton extends between the member and the at least one appendage, retaining means for temporarily securing a portion of at least one appendage to the decorative body whereby a passage is defined wherein a hanging, flexible material is releasably retained; and hanging means comprising a first part positioned on a surface of the decorative body and a second part positioned on a mounting surface, wherein the first part engages the second part to mount the decorative body thereto.

8. The hanging, flexible material retainer of claim 7 wherein the decorative body includes at least two appendages and the skeleton extends to less than all the appendages.

9. A method for disposing a fabric retainer to alter the natural repose of a piece of hanging, flexible material, said method comprising:

providing a decorative body having a member flexibly connected to at least one appendage extending therefrom; providing a hanging means for the decorative body hanging the decorative body on a mounting surface by the hanging means; and releasably securing a portion of the at least one appendage to the decorative body such that a passage is defined in which the hanging material is releasably retained.

10. The method of claim 9, wherein said at least one appendage includes a fastener retaining means, said releasably securing a portion of the at least one appendage to the decorative body comprising engaging the fastener retaining means with at least one other appendage flexibly extending from the member.

11. The method of claim 9, wherein said at least one appendage includes a fastener retaining means, said releasably securing a portion of the at least one appendage to the decorative body comprising engaging the fastener retaining means with the member.

12. The method of claim 9, wherein the hanging retainer means is a multiple part hanging means including a first part positioned on a surface of the decorative body and a second part positioned on the mounting surface, said hanging the decorative body on a mounting surface comprising engaging the first part with the second part to mount the decorative body thereto.

* * * * *